United States Patent [19]

Donato et al.

[11] Patent Number: 4,577,266

[45] Date of Patent: Mar. 18, 1986

[54] CEILING MOUNTED LIGHTING FIXTURE WITH THERMAL PROTECTOR

[75] Inventors: Anthony C. Donato, Westfield; Alex Kartavenko, Clifton, both of N.J.

[73] Assignee: Lightolier Incorporated, Jersey City, N.J.

[21] Appl. No.: 700,487

[22] Filed: Feb. 11, 1985

[51] Int. Cl.[4] ..... F21V 7/00

[52] U.S. Cl. ..... 362/296; 362/306; 362/365; 362/396; 362/406

[58] Field of Search ..... 362/306, 296, 147, 365, 362/368, 370, 371, 396, 406

[56] References Cited

U.S. PATENT DOCUMENTS

| | | | |
|---|---|---|---|
| 3,302,019 | 1/1967 | Menzin | 362/296 |
| 3,375,368 | 3/1968 | Dorsky | 362/306 |
| 3,721,817 | 3/1973 | Contratto | 362/365 |
| 4,274,615 | 6/1981 | Chan et al. | 362/365 |
| 4,327,403 | 4/1982 | Capostagno et al. | 362/296 |
| 4,336,575 | 6/1982 | Gilman | 362/147 |
| 4,388,679 | 6/1983 | Blaisdell et al. | 362/306 |
| 4,510,559 | 4/1985 | Kristofek | 362/365 |

*Primary Examiner*—E. Rollins Cross

*Attorney, Agent, or Firm*—Arthur B. Colvin

[57] ABSTRACT

A fixture including thermal sensing means is disclosed which fixture is especially adapted to be mounted in existing ceiling construction. The fixture includes a shroud having a cut-away portion enabling the fixture to be inserted in angularly oriented position relative to the ceiling and thereafter tilted into mounted position in the ceiling. The fixture includes spring clips insertable after the shroud is mounted into clamping engagement with the upper surface of the ceiling to securely connect the shroud to the ceiling.

5 Claims, 5 Drawing Figures

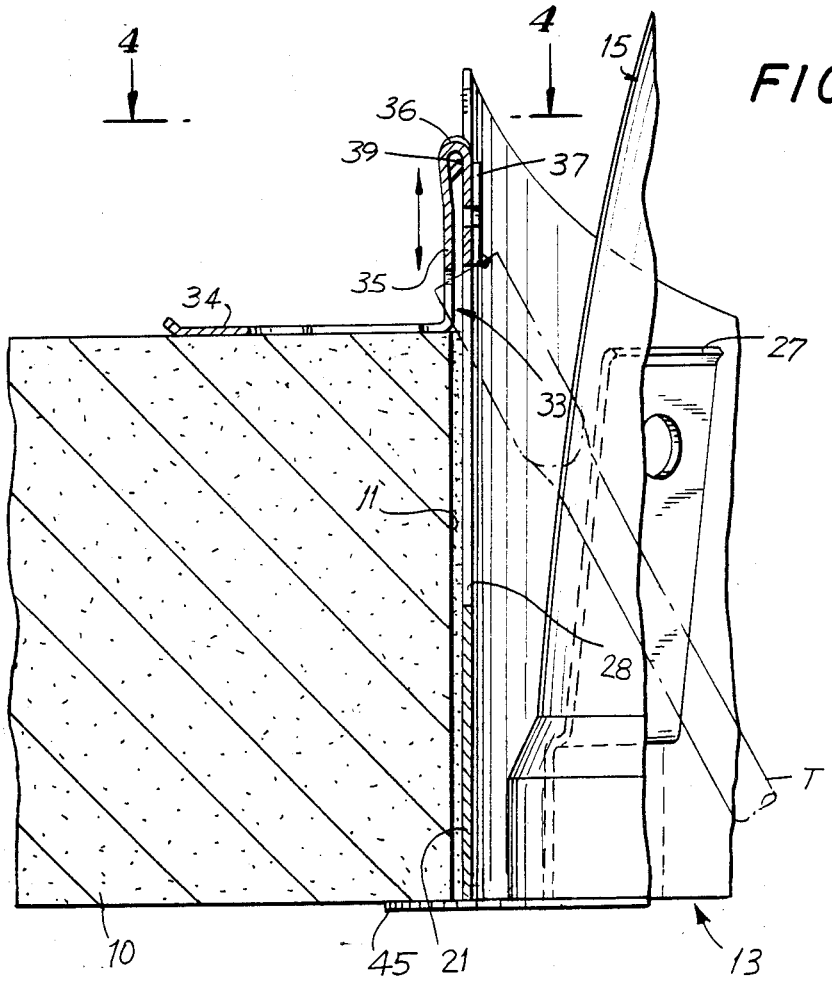
FIG. 3
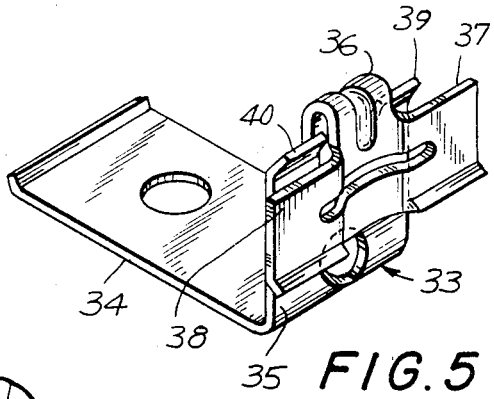
FIG. 5
FIG. 4
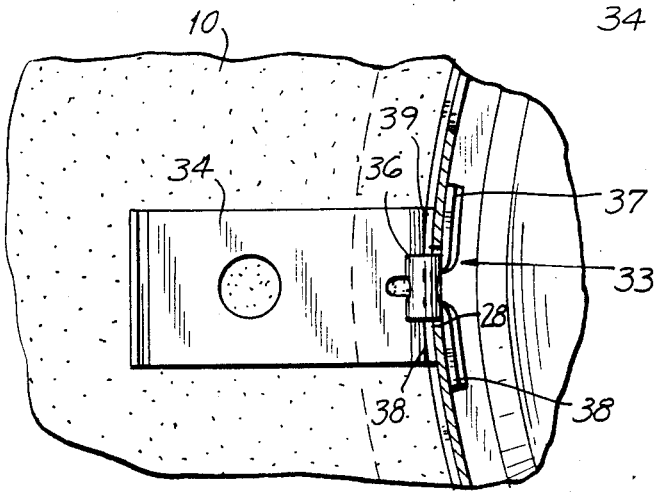

CEILING MOUNTED LIGHTING FIXTURE WITH THERMAL PROTECTOR

BACKGROUND OF THE INVENTION

1. Field of the Invention

The present invention is in the field of lighting fixtures and pertains more particularly to a ceiling mounted lighting fixture equipped with thermal protector circuitry. More particularly, the invention relates to a ceiling mounted fixture especially adapted to remodeling applications for installation in an existing ceiling structure.

2. The Prior Art

A recent development in the lighting fixture art involves the application to lighting fixtures and particularly incandescent lighting fixtures of a heat sensor device. It is the function of the heat sensor device to detect undue heat build-up in an area adjacent the lighting fixture. Undue heat build-up is frequently encountered in instances in which insulation or like bulk materials are disposed so close to the reflector of a ceiling mounted lighting fixture as to prevent the dissipation of heat.

In order to be effective the heat sensor must be mounted at a position spaced away from the reflector. Typically, ceiling mounted fixtures incorporating heat sensing devices include a stand-off extending eight inches to a foot from the reflector, the stand-off carrying at the end remote from the reflector a junction or connector box which includes the mains conductors for the lighting fixture and in addition the heat sensing mechanism.

Fixtures of the type described may be readily and effectively installed prior to installation of the ceiling assembly, since under such circumstances it is simple to structurally unite the fixture to the ceiling support apparatus or joists. However, no ceiling mounted fixture heretofore known and including a stand-off heat sensor mechanism has been adapted to be effectively mounted to an existing ceiling assembly.

The difficulties of mounting a heat sensing fixture to an existing ceiling reside in the fact that the mounting aperture in the ceiling, for esthetic reasons, must correspond to the size of the frame or bezel of the fixture which is exposed beneath the ceiling. However, due to the fact that the heat sensor mechanism must be spaced from the reflector assembly, it has been impossible with fixtures of the type heretofore known to pass the sensor mechanism through the fixture mounting aperture in the ceiling and thereafter insert the fixture itself into the noted aperture. Moreover, no efficient means has been devised for clamping the supporting fixture of the type described to the ceiling per se, such that the ceiling itself functions as a structural support for the fixture.

Efforts have been made to design conventional (non-heat sensing) fixtures which may be mounted to an existing ceiling structure. U.S. Pat. No. 4,327,403 represents an example of such attempts. However, the cited reference has been found ineffective in respect of a heat sensing fixture due to the substantial length of the stand-off mechanism required to support the heat sensor.

SUMMARY OF THE INVENTION

The present invention may be summarized as directed to a ceiling mounted fixture of the heat sensing type adapted for use in remodeling applications where the fixture is to be applied to an existing ceiling construction. The fixture in accordance with the invention is comprised of a shroud assembly which carries the heat sensing mechanism in a junction box or connector box supported in spaced relation to the shroud. The shroud is generally cylindrical in conformation and includes at a portion opposite the extension employed for supporting the connector box a recessed area extending downwardly from the upper end of the shroud. The shroud also includes radially projecting flanges extending generally in the plane of the base of the shroud which are adapted to rest against the under surface of the ceiling. Spring clips are adapted to be mounted in downwardly directed slots formed in the shroud. The fixture is mounted to the ceiling by tilting the fixture about a horizontal pivot axis perpendicular to the axis of the extension supporting the junction box, passing the junction box upwardly through the ceiling and thereafter pivoting the fixture about the noted axis, final positioning of the fixture being accommodated by the cut-out or clearance area formed on the upper end of the shroud. With the fixture positioned with the flanges of the shroud engaging the under surface of the ceiling, the frictional spring clips are inserted and shifted downwardly in the described slots, the clips including projections which bear against the upper surface of the ceiling so as firmly to clamp the shroud in position between the flanges and projections. After the shroud is positioned a bulb holder assembly is connected to a reflector, and the reflector is shifted upwardly into the shroud which includes spring fingers adapted to frictionally grip the outer surfaces of the reflector and support the same and hence the bulb holder assembly in a desired position.

It is accordingly an object of the present invention to provide a lighting fixture of the incandescent type which includes a heat sensor mechanism, the fixture being subject to remodeling uses by being insertable into mounted position in an existing ceiling structure.

A further object of the invention is the provision of a heat sensing fixture of the type described which is constructed and arranged to enable facile and secure mounting to an existing ceiling construction, the fixture being supported solely by connection to the material of the ceiling.

DESCRIPTION OF VIEWS

In order to attain these objects and such other objects as may appear herein or be hereinafter pointed reference is made to the accompanying drawings in which:

FIG. 3 is a magnified vertical section taken on the line 3—3 of FIG. 2.

FIG. 4 is a horizontal section taken on the line 4—4 of FIG. 3.

FIG. 5 is a perspective view of a spring clip construction forming a part of the fixture.

Figure 1:
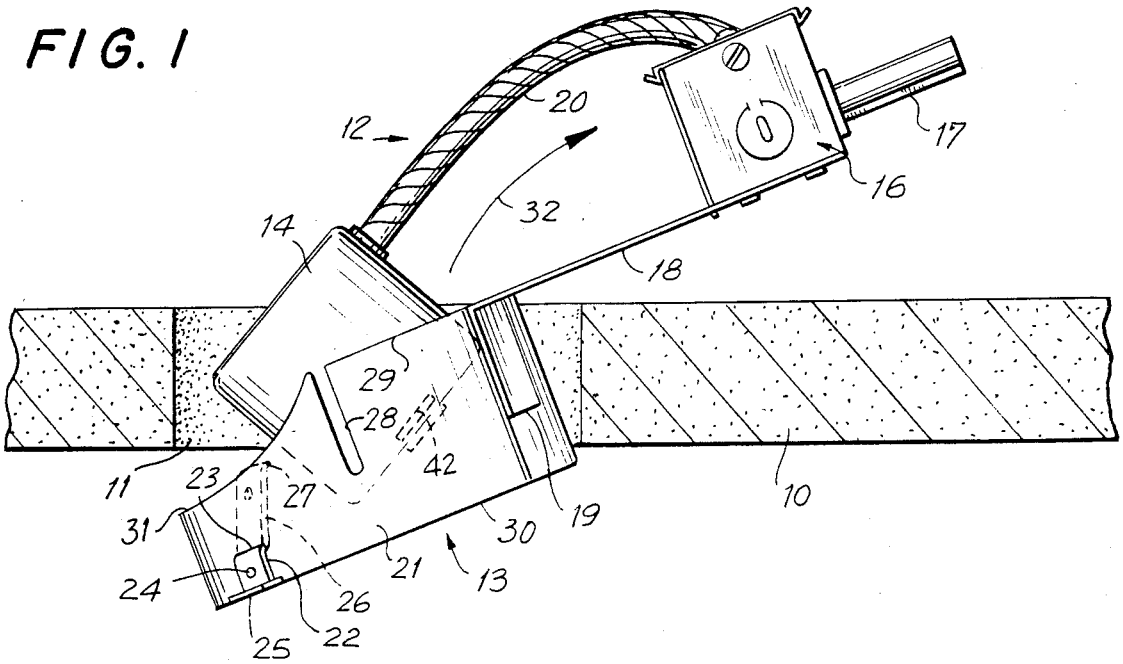
FIG. 1 is a sectional view through a ceiling showing the fixture components at an interim position in the course of installation.
Figure 2:
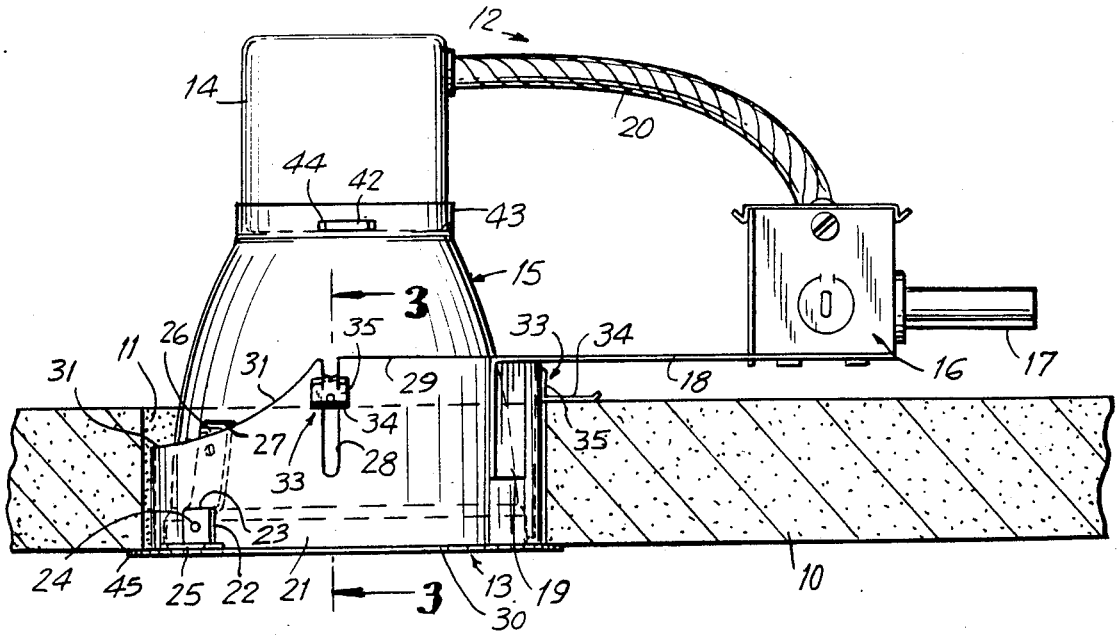
FIG. 2 is a view similar to FIG. 1 showing the fixture installed in the ceiling.

Referring now to the drawings there is shown in FIGS. 1 and 2 sectional views depicting a ceiling member 10 having formed therethrough a mounting aperture 11 within which is to be positioned the replacement fixture 12. The fixture 12 is comprised of four main parts, namely a mounting shroud 13, a bulb housing 14, a reflector assembly 15 and a junction box 16 which carries heat sensor 17.

As hereinbefore noted, it is necessary for the proper functioning for the heat sensing device, that the sensor 17 be displaced a substantial distance from the reflector. Accordingly, the junction or connector box 16 and sensor 17 are mounted on a strut or stand-off 18, one end 19 of which is secured to the shroud. Electrical connections to the bulb socket (not shown) within bulb housing 14 extend between the said housing and the connector or junction box 16, the connections being disposed within a B-X cable 20.

The principal advance of the present invention resides in the manner in which the shroud assembly 13 is mounted to the ceiling. As will be readily recognized from an inspection of the drawings, the presence of the stand-off 18 and junction box 16 in spaced relation to the shroud precludes the possibility of the shroud being mounted in mounting aperture by a simple upward movement of the shroud. The means by which the shroud is mounted will next be described.

The shroud 13 comprises a generally cylindrical skirt portion 21. As best seen in FIGS. 1, 2 and 3 the shroud includes a plurality of angularly spaced apart stop members 22 which extend through slots 23 formed in the shroud. The stop members 22 which are secured in the desired position as by rivets 24 include outwardly projecting flanges 25 which in the mounted position of the shroud will underlie and bear against the under surface of the ceiling 10.

In addition, the stop members include spring fingers 26 which project radially inwardly of the shroud, the distal ends 27 of the fingers 26 being formed with sharp edges adapted to engage against side portions of the reflector 15 and support the same in mounted position within the shroud. Optionally, but preferably, the edge portions 27 of the fingers may be inclined in the manner taught by U.S. Pat. No. 4,039,822 to thereby enable the reflector to be removed only by a combined turning and downward pulling force exerted thereagainst. Preferably, the rivet connection 24 permits a minor degree of pivotal movement of the stop members 22 relative to the shroud.

The skirt portion 21 of the shroud is provided with a series of vertically directed and angularly spaced apart mounting slots 28 extending from the upper edge 29 of the shroud downwardly toward the base 30 thereof.

In order to permit the shroud 13, stand-off 18 and junction box 16 to be positioned within the aperture 11 in the ceiling, the upper edge of the shroud is cut away as at 31. The cut away portion 31 enables the shroud to be disposed within aperture 11 by inclining the same as shown in FIG. 1 and thereafter pivoting the same upwardly in the direction of arrow 32 (see FIG. 1), the removal of material in the area 31 providing clearance for pivoting movement of the shroud from the position shown in FIG. 1 to the position shown in FIG. 2.

With the shroud disposed within the aperture 11, spring clip members 33 shown in detail in FIG. 5 are inserted into the slots 28 such that the flange portions 34 of the spring clips bear against the upper surface of the ceiling 10 to maintain the shroud in the horizontal or mounted position shown. The spring clips include an upwardly directed leg 35 which in the mounted position of the clip bears against the outer face of the shroud, a U-shaped neck portion 36 having a transverse dimension adapted to lie within the slots 28, and laterally projecting wing portions 37–38 extending from the portion 36. The clip includes inwardly directed teeth 39–40 lying to opposite sides of the member 36, the teeth including sharpened edges which bite into the exterior surface of the shroud. The inclination of the teeth 39–40 is such as to permit them to be slid downwardly within slots 28, but to be resistant to return upward movements within the slots.

Preferably, the flange portions 34 extend from the upwardly directed portions 35 at an angle slightly in excess of 90°. This permits the flanges to exert a downward springing force against the upper surface of the ceiling when the spring clips are forced downwardly along slots 28.

As is conventional, the bulb housing 14 includes a pair of laterally outwardly projecting spring detents 42. The reflector 15 includes a cylindrical attachment portion 43 having opposed throughgoing slots 44. The reflector is thus connected to the bulb housing 14 by sleeving the upper end 43 of the reflector 15 over the lower end of the housing 14 until the detents 42 snap outwardly into slots 44.

The complete operation of installation of the fixture will be readily understood from the foregoing description. Mains connections are effected to junction box 16. The shroud member 13 is thereafter mounted to the ceiling by passing the assembly upwardly, junction box end first, in a tilted position as shown in FIG. 1 and thereafter pivoting the same in the direction of the arrow 32 until the flange portions 25 of the stop members 22 bear against the under surface of the ceiling. With the parts thus positioned the spring clips 33 are inserted into the slots 28 and shifted downwardly.

Optionally, and to facilitate downward movement, a screwdriver or like tool T may be used to pry open the clips and ease the downward shifting movement. Downward movement of the clips is continued until the flange portions 34 thereof are biased tightly against the upper surface of the ceiling, the force of downward movement shifting the flanges from the slightly greater than 90° position to a substantially right angular position.

After the shroud assembly is securely disposed within the ceiling the reflector 15 is snapped fittedly connected to the bulb housing 14 by causing the detents 42 to project outwardly through slots 44 in the reflector. Thereafter the reflector is shifted upwardly into the position shown in FIG. 2, the reflector being held in the mounted position by the inward pressure of the sharpened edge portions 27 of the fingers 26. The reflector member 15 includes an annular outwardly projecting flange or bezel 45 which laps the interface between the skirt of the shroud and the opening 11 in the ceiling, so as to conceal the opening.

From the foregoing description it will be appreciated that there is described and illustrated in accordance with the invention a ceiling supported lighting fixture especially useful in remodeling operations wherein it is impracticable to effect direct connection between the fixture and elements above the ceiling structure. By reason of the recess formed in the shroud in an area diametrically opposite the radially projecting stand-off member, it is possible to insert the supporting shroud from a position below the ceiling in an angled orientation and thereafter tilt the same into a desired horizontal position, whereat it may securely supported between the spring clips at the upper surface of the ceiling and the stop members at the lower surface.

A significant feature of the invention resides in the fact that the stop members which engage the under surface of the ceiling include integral portions which also engage the reflector. In this manner the reflector is directly connected to elements which engage the ceiling, rather than to a shroud which in turn engages or is caused to engage the ceiling. In this manner the reflector may be adjusted for slight irregularities in the ceiling not withstanding the shroud may be disposed in slightly tilted, inclined or canted position.

As will be apparent to those skilled in the art and familiarized with the instant disclosure numerous variations may be made in the details of construction thereof without departing from the spirit of the invention.

Accordingly, the same is to be broadly construed with the scope of the appended claims.

Having thus described the invention and illustrated its use, what is claimed as new and is desired to be secured by Letters Patent in the United States is:

1. A ceiling mounted lighting fixture adapted to be clampingly secured to a ceiling panel or the like by insertion from beneath said panel through a mounting aperture formed in said panel, said fixture comprising a generally cylindrical mounting shroud, a stand-off member secured to said shroud and projecting radially outwardly therefrom, a connector box including thermal sensor means mounted on the end of said stand-off remote from said shroud, said shroud including at the upper edge thereof a recess portion of reduced height at a position diametrically opposite said stand-off, a plurality of stop members mounted on said shroud in angularly spaced relation thereabout, said stop members including radially outwardly projecting stop flanges disposed substantially in the plane of the lowermost end of said shroud, a plurality of slots formed in said shroud, said slots extending generally in the direction of the axis of said shroud, the lowermost ends of said slots terminating in spaced relation to the lowermost end of said shroud, a plurality of spring clip members insertable into said slots, said clip members including ceiling clamp portions projecting radially outwardly of said shroud, and shroud engaging portions in frictional engagement with and shiftable axially along said slots whereby said shroud may be mounted within said ceiling by inclining said shroud from the horizontal, passing said stand-off and connector box upwardly through said mounting aperture, tilting said shroud about a turning axis normal to the axis of said stand-off to position said shroud in said mounting aperture and thereafter inserting said clip members into said slots and shifting the same downwardly to thereby clamp said ceiling between said stop flanges and clamp portions, the combination including a bulb housing, a flexible mains connector extending between said housing and said connector box, a reflector, and complemental clamp means interposed between said housing and said reflector for mounting said housing to said reflector.

2. Apparatus in accordance with claim 1 wherein said stop members include gripper edges projecting radially inwardly of said shroud, the combination including a reflector member upwardly insertable into said shroud, said reflector member including a mounting portion frictionally engaging said gripper edges.

3. Apparatus in accordance with claim 2 wherein said stop members are pivotally secured to said shroud.

4. Apparatus in accordance with claim 3 wherein said ceiling clamp portions of said spring clip members are normally disposed in an angle slightly in excess of 90° relative to the portions of said clip members engaging said slots.

5. Apparatus in accordance with claim 1 wherein said stop members incude gripper edges projecting radially inwardly of said shroud, said reflector being upwardly insertable into said shroud, said reflector including a mounting portion frictionally engaging said gripper edges.

* * * * *